US010410849B2

(12) United States Patent
Guna

(10) Patent No.: US 10,410,849 B2
(45) Date of Patent: Sep. 10, 2019

(54) MULTIPOLE ION GUIDE

(71) Applicant: DH Technologies Development PTE Ltd., Singapore (SG)

(72) Inventor: Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/559,520

(22) PCT Filed: Mar. 22, 2016

(86) PCT No.: PCT/IB2016/051609

§ 371 (c)(1),
(2) Date: Sep. 19, 2017

(87) PCT Pub. No.: WO2016/157030

PCT Pub. Date: Oct. 6, 2016

(65) Prior Publication Data

US 2018/0122627 A1 May 3, 2018

Related U.S. Application Data

(60) Provisional application No. 62/141,456, filed on Apr. 1, 2015.

(51) Int. Cl.
*H01J 49/06* (2006.01)

(52) U.S. Cl.
CPC ..... *H01J 49/063* (2013.01)

(58) Field of Classification Search
CPC ..... H01J 49/063; H01J 49/06; H01J 49/061; H01J 49/062
USPC ..... 250/281, 282, 288
See application file for complete search history.

(56) References Cited

U.S. PATENT DOCUMENTS

| | | | | |
|---|---|---|---|---|
| 6,730,904 | B1 | 5/2004 | Wells | |
| 2007/0120053 | A1 | 5/2007 | Loboda | |
| 2009/0302216 | A1 | 12/2009 | Londry | |
| 2015/0048246 | A1 * | 2/2015 | Green | H01J 49/065 250/283 |

FOREIGN PATENT DOCUMENTS

| | | | | |
|---|---|---|---|---|
| WO | 2008157019 | A2 | 12/2008 | |
| WO | 2014057345 | A2 | 4/2014 | |
| WO | WO 2015173562 | A1 * | 11/2015 | H01J 49/004 |

OTHER PUBLICATIONS

International Search Report and Written Opinion for PCT/IB2016/051609 dated Jul. 25, 2016

* cited by examiner

*Primary Examiner* — Nicole M Ippolito
*Assistant Examiner* — Hanway Chang

(57) ABSTRACT

Systems and methods described herein utilize an ion guide for use in mass spectrometer systems, which ion guide can receive ions from an ion source for transmission to downstream mass analyzers, while preventing debris (e.g., unsolvated droplets, neutral molecules, heavy charged clusters) from being transmitted into a high-vacuum chamber of the mass spectrometer system. In various aspects, systems and methods in accordance with the present teachings can increase throughput, improve the robustness of the system, and/or decrease the downtime typically required to disassemble/clean sensitive components within the high-vacuum portions of the mass spectrometer system.

19 Claims, 6 Drawing Sheets

MULTIPOLE ION GUIDE

RELATED APPLICATIONS

This application claims the benefit of priority from U.S. Provisional Application Ser. No. 62/141,456, filed on Apr. 1, 2015, the entire contents of which is incorporated by reference, herein.

FIELD

The invention generally relates to mass spectrometry, and more particularly to methods and apparatus utilizing a multipole ion guide for transmitting ions.

INTRODUCTION

Mass spectrometry (MS) is an analytical technique for determining the elemental composition of test substances with both quantitative and qualitative applications. For example, MS can be used to identify unknown compounds, to determine the isotopic composition of elements in a molecule, and to determine the structure of a particular compound by observing its fragmentation, as well as to quantify the amount of a particular compound in the sample.

In mass spectrometry, sample molecules are generally converted into ions using an ion source and then separated and detected by one or more mass analyzers. For most atmospheric pressure ion sources, ions pass through an inlet orifice prior to entering an ion guide disposed in a vacuum chamber. In conventional mass spectrometer systems, a radio frequency (RF) voltage applied to the ion guide provides collisional cooling and radial focusing along the central axis of the ion guide as the ions are transported into a subsequent, lower-pressure vacuum chamber in which the mass analyzer(s) are disposed. While the size of the inlet orifice between the ion source and ion guide can be increased so as to increase the number of ions entering the ion guide (thereby potentially increasing the sensitivity of MS instruments), higher pressures in the first stage vacuum chamber from the increased gas flow can reduce the ability of the ion guide to focus the ions due to increased collisions with ambient gas molecules. Moreover, though ionization at atmospheric pressure (e.g., by chemical ionization, electrospray) is generally a highly efficient means of ionizing the analyte(s) of interest, contaminating/interfering ions and neutral molecules (e.g., heavy clusters) can also be created in high abundance. If such debris enters downstream mass analyzer stages located deep inside high-vacuum chambers where trajectories of the ions of interest can be precisely controlled by electric fields, these molecules can foul/contaminate these downstream elements. Such contamination can interfere with the mass spectrometric analysis and/or lead to increased costs or decreased throughput necessitated by the cleaning of critical components within the high-vacuum chamber(s). Because of the higher sample loads and contaminating nature of the biologically based samples being analyzed with current day atmospheric pressure ionization sources, maintaining a clean mass analyzer remains a critical concern.

Accordingly, there remains a need for methods and systems that enable the analysis of increasingly complex samples with improved sensitivity, while reducing contamination of downstream mass analyzers.

SUMMARY

The systems and methods described herein utilize an ion guide for use in mass spectrometer systems, which ion guide can receive ions from an ion source for transmission to one or more downstream mass analyzers, while preventing debris (e.g., unsolvated droplets, neutral molecules, heavy charged clusters) from being transmitted into a high-vacuum chamber of the mass spectrometer system. In various aspects, systems and methods in accordance with the present teachings can increase throughput, improve the robustness of the system, and/or decrease the downtime typically required to disassemble/clean sensitive components within the high-vacuum portions of the mass spectrometer system.

In accordance with various aspects of the applicant's present teachings, a mass spectrometer system is provided, comprising an ion source for generating ions and an ion guide chamber, the ion guide chamber comprising an inlet orifice for receiving the ions generated by the ion source and at least one exit aperture for transmitting the ions from the ion guide chamber (e.g., into a downstream high-vacuum chamber for housing one or more mass analyzers). An ion guide in accordance with the present teachings can be disposed in the ion guide chamber, the ion guide comprising a plurality of elongate electrodes extending from a proximal end adjacent the inlet orifice to a distal end adjacent the exit aperture, the plurality of electrodes spaced from and extending alongside a central longitudinal axis of the ion guide so as to define an elongated space between the plurality of electrodes through which the ions are transmitted from the proximal end of the ion guide to the distal end of the ion guide. The inlet orifice can be disposed on the central longitudinal axis of the ion guide and the at least one exit aperture can be disposed offset from the central longitudinal axis. The system can also comprise a power supply connected to the ion guide, wherein the power supply is configured to apply a signal to the plurality of elongate electrodes so as to generate an electric field at least at a distal portion of the ion guide that provides an average radial force on the ions away from the central longitudinal axis of the ion guide for transmission through the exit aperture.

In certain aspects, the electric field exhibits a central field axis offset from the central longitudinal axis of the ion guide axis, the exit aperture being disposed on the central field axis. By way of example, the electric field can have a longitudinal (axial) component that is offset and substantially parallel to the longitudinal axis of the ion guide.

In some aspects, the electric field at the distal portion of the ion guide can exhibit a plurality of pseudopotential wells offset from the central longitudinal axis. In related aspects, the at least one exit aperture can comprise an annular aperture, wherein the inner circle defining the annular aperture is disposed on the central longitudinal axis. Alternatively, the at least one exit aperture can comprise a plurality of exit apertures, each of which is aligned with at least one of the plurality of pseudopotential wells.

The plurality of elongate electrodes can have a variety of configurations. In accordance with various aspects, for example, the plurality of elongate electrodes can comprise at least eight electrodes (e.g., 12 or more electrodes). In some related aspects, the power supply can be configured to apply an RF signal to the electrodes such that the RF signal applied to each electrode is of the same frequency and opposite phase of adjacent electrodes, and such that three non-adjacent electrodes have an RF signal applied thereto having an amplitude greater than the RF signal applied to the remainder of the electrodes. Additionally, in some related aspects, the power supply can also be configured to apply a DC voltage to each of the electrodes such that the DC voltage applied to two of the three non-adjacent electrodes is more attractive to the ions to be transmitted from the ion guide (e.g., into a downstream high-vacuum chamber) relative to the DC voltage applied to the other of the plurality of electrodes.

In various aspects, the power supply can be configured to apply an RF and DC signal to each of the electrodes such that the RF signal applied to each electrode is of the same amplitude and frequency and of opposite phase of the RF signal applied to adjacent electrodes, wherein the DC voltage applied to two non-adjacent electrodes is more attractive to the ions to be transmitted from the ion guide relative to the DC voltage applied to the other of the electrodes. In some related aspects, the two non-adjacent electrodes can exhibit an increasing cross-sectional area along a length of said distal portion (e.g., conical), while the other electrodes can exhibit a substantially constant cross-sectional area along this length, for example.

In some aspects, the power supply can be configured to apply an RF and DC signal to each of the electrodes such that the RF signal applied to each electrode is of the same frequency and of opposite phase of the RF signal applied to adjacent electrodes. Where one electrode of the electrodes exhibits an increasing cross-sectional area along a length of said distal portion and the others of said electrodes exhibit a substantially constant cross-sectional area along this length, the power supply can be configured such that the amplitude of the RF signal applied to the one electrode is less than the other electrodes and the DC voltage applied to the one electrode is more attractive to the ions to be transmitted from the ion guide relative to the DC voltage applied to the other electrodes.

In accordance with various aspects of the present teachings, a method of processing ions is provided, the method comprising receiving ions generated by an ion source through an inlet orifice of an ion guide chamber and transmitting ions through an ion guide disposed in the ion guide chamber, the ion guide comprising a plurality of elongate electrodes (e.g., at least eight electrodes) extending from a proximal end adjacent the inlet orifice to a distal end adjacent at least one exit aperture of the ion guide chamber. The plurality of electrodes are spaced from and extend alongside a central longitudinal axis of the ion guide so as to define an elongated space between the plurality of electrodes through which the ions are transmitted from the proximal end of the ion guide to the distal end of the ion guide, wherein the inlet orifice is disposed on the central longitudinal axis of the ion guide and the at least one exit aperture is disposed offset from the central longitudinal axis. The method also comprises applying an electrical signal to the plurality of elongate electrodes so as to generate an electric field at least at a distal portion of the ion guide that provides an average radial force on the ions away from the central longitudinal axis of the ion guide and transmitting the ions from the ion guide through the exit aperture to one or more downstream mass analyzers. In some aspects, the electric field exhibits a central field axis offset from the central longitudinal axis of the ion guide axis, and the exit aperture is disposed on the central field axis. In various aspects, the electric field at the distal portion of the ion guide exhibits a plurality of pseudopotential wells offset from the central longitudinal axis.

In various aspects, applying the electrical signal to the plurality of elongate electrodes can comprise applying an RF signal to each electrode of the same frequency and opposite phase of the signal applied to adjacent electrodes such that three non-adjacent electrodes have an RF signal applied thereto having an amplitude greater than the RF signal applied to the remainder of the electrodes. In related aspects, applying the electrical signal to the plurality of elongate electrodes can further comprise applying a DC voltage to each of the electrodes such that the DC voltage applied to two of said three non-adjacent electrodes is more attractive to the ions to be transmitted from the ion guide relative to the DC voltage applied to the other of the plurality of electrodes.

In some aspects of the present teachings, applying an electrical signal to the plurality of elongate electrodes comprises applying an RF signal to each of the electrodes of the same amplitude and frequency and of opposite phase of the RF signal applied to adjacent electrodes; and applying a DC voltage to two non-adjacent electrodes that is more attractive to the ions to be transmitted from the ion guide relative to the DC voltage applied to the other of the electrodes.

In some aspects, applying the electrical signal to the plurality of elongate electrodes can comprise applying an RF and DC signal to each of the electrodes such that the RF signal applied to each electrode is of the same frequency and of opposite phase of the RF signal applied to adjacent electrodes; wherein at least one electrode of the plurality of electrodes exhibits a non-uniform cross sectional area (e.g., an increasing cross-sectional area along a length of the distal portion of the electrode) and the others of said electrodes exhibit a substantially constant cross-sectional area along their entire length; wherein the amplitude of the RF signal applied to said at least one electrode is less than the RF signal applied to said other electrodes; and wherein the DC voltage applied to said one electrode is more attractive to the ions to be transmitted from the ion guide relative to the DC voltage applied to the other electrodes.

These and other features of the applicant's teachings are set forth herein.

BRIEF DESCRIPTION OF THE DRAWINGS

The foregoing and other objects and advantages of the invention will be appreciated more fully from the following further description, with reference to the accompanying drawings. The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

Methods and systems for preventing debris (e.g., unsolvated droplets, neutral molecules, heavy charged clusters) from being transmitted into the high-vacuum chambers of mass spectrometer systems are provided herein. By reducing fouling of the sensitive components housed deep within the high-vacuum chambers of a mass spectrometer system, the present teachings can increase throughput, improve robustness, and/or decrease the downtime typically required to disassemble/clean the mass spectrometer system.

Figure 1:
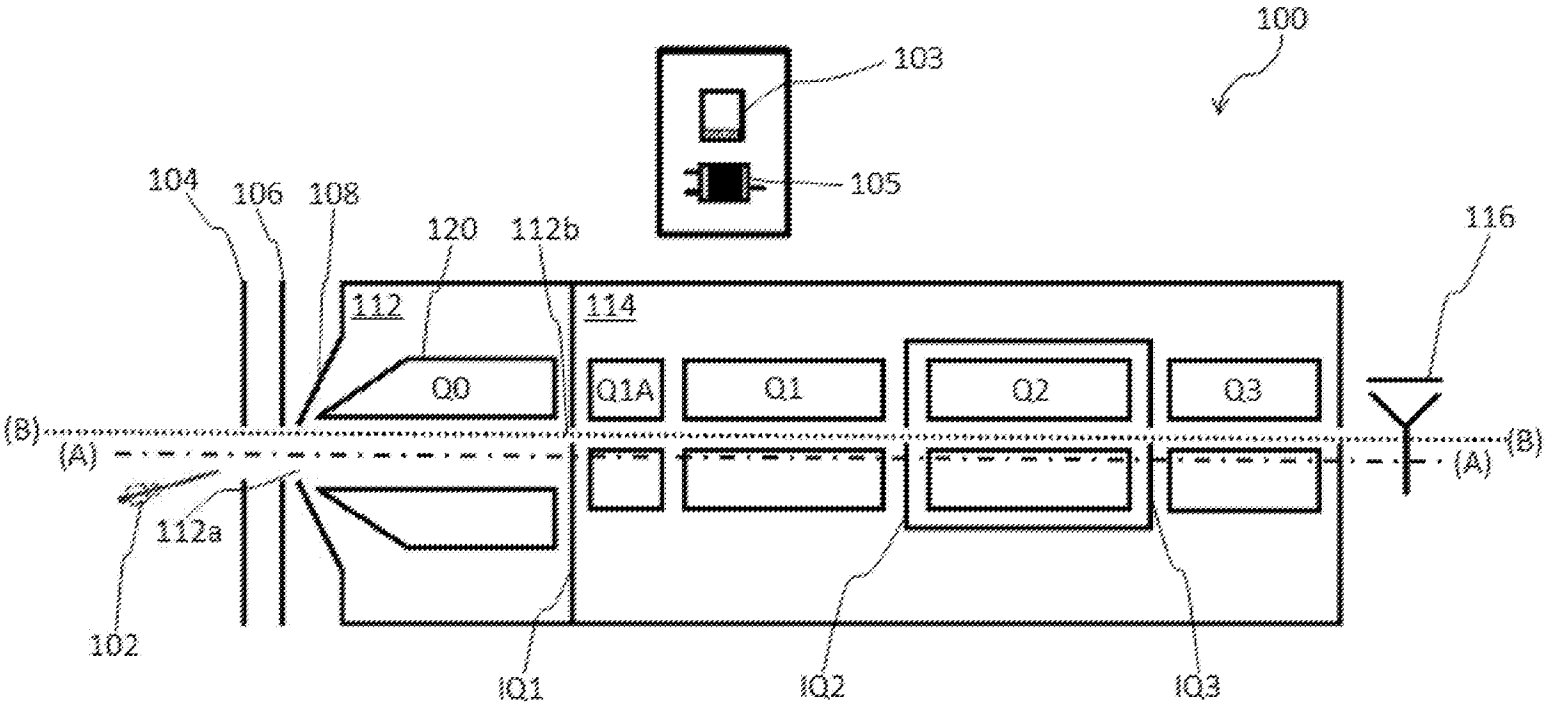
FIG. 1, in schematic diagram, illustrates an exemplary mass spectrometry system having an ion guide in accordance with aspects of various embodiments of the applicant's teachings.

While the systems, devices, and methods described herein can be used in conjunction with many different mass spectrometer systems, an exemplary mass spectrometer system 100 in accordance with various aspects of the present teachings is illustrated schematically in FIG. 1. It should be understood that the mass spectrometer system 100 represents only one possible mass spectrometer instrument for use in accordance with embodiments of the systems, devices, and methods described herein, and mass spectrometers having other configurations can be used as well. By way of example, in some embodiments, a mass spectrometer as disclosed in an article entitled "Product ion scanning using a Q-q-$Q_{linear}$ ion trap (Q TRAP®) mass spectrometer," authored by James W. Hager and J. C. Yves Le Blanc and published in Rapid Communications in Mass Spectrometry (2003; 17: 1056-1064), which is hereby incorporated by reference in its entirety, can be modified in accordance with the present disclosure to implement various aspects of the applicant's teachings.

As shown schematically in the exemplary embodiment depicted in FIG. 1, the mass spectrometer system 100 generally includes an ion source 102, a multipole ion guide 120 (i.e., Q0) housed within a first vacuum chamber 112, one or more mass analyzers (e.g., Q1, Q2, and Q3) housed within a second vacuum chamber 114, and a detector 116 (e.g., a Faraday cup or other ion current measuring device effective to detect the ions transmitted through the mass analyzers). Though the exemplary second vacuum chamber 114 houses three mass analyzers (i.e., elongated rod sets Q1, Q2, and Q3), it will be appreciated that more or fewer mass analyzer elements can be included in systems in accordance with the present teachings.

As shown in FIG. 1, ions generated by the ion source 102 can be extracted into a coherent ion beam by passing the ions successively through apertures in an aperture plate 104, an orifice plate 106, and a skimming plate 108 prior to entering the first vacuum chamber 112. In various embodiments, an intermediate pressure chamber can be located between the orifice plate 106 and the skimmer 108 and can be evacuated to a pressure approximately in the range of about 1 Torr to about 4 Torr, though other pressures can be used for this or for other purposes. In some embodiments, upon passing through the skimmer 108, the ions can traverse one or more additional vacuum chambers and/or quadrupoles (e.g., a QJet® quadrupole) to provide additional focusing of and finer control over the ion beam using a combination of gas dynamics and radio frequency fields prior to being transmitted into the ion guide 120. In accordance with various aspects of the present teachings, it will also be appreciated that the exemplary ion guides described herein can be disposed in a variety of front-end locations of mass spectrometer systems. By way of non-limiting example, the ion guide 120 can serve in the conventional role of a QJet® ion guide (e.g., operated at a pressure of about 1-10 Torr), as a conventional Q0 focusing ion guide (e.g., operated at a pressure of about 3-15 mTorr) preceded by a QJet® ion guide, as a combined Q0 focusing ion guide and QJet® ion guide (e.g., operated at a pressure of about 3-15 mTorr), or as an intermediate device between a the QJet® ion guide and Q0 (e.g., operated at a pressure in the 100s of mTorrs, at a pressure between a typical QJet® ion guide and a typical Q0 focusing ion guide).

In the exemplary system 100 depicted in FIG. 1, the first vacuum chamber 112 houses the ion guide 120 and includes an orifice plate (e.g., skimming plate 108) having an inlet orifice 112*a* through which ions are received from the ion source 102 and an orifice plate IQ1 having an exit aperture 112*b* through which ions transmitted by the ion guide 120 are transferred to the second vacuum chamber 114 for further processing. As discussed in detail below, the exemplary multipole ion guide 120 generally defines a central longitudinal axis (A) aligned with the inlet orifice 112*a* and along which the ions can be initially injected from the ion source 102 into the multipole ion guide 120. Whereas conventional front-end RF multipole ion guides generally radially focus toward this central longitudinal axis (A) as the ions are collisionally cooled during transmission toward an exit aperture also disposed on the central longitudinal axis (A), multipole ion guides in accordance with various aspects of the present teachings provides an average radial force on the ions away from the central longitudinal axis (A) (e.g., the ions' injection axis) to enable transmission through an exit aperture 112*b* offset from the central longitudinal axis (A). Because debris such as droplets, neutral ions, and heavy, charged clusters may be less susceptible to the radial forces generated by the electric field in the ion guide 120, the debris collides with the orifice plate IQ1 (e.g., impinges on the central area of the exit lens) rather than being transferred through the offset exit aperture 112*b*. As will be appreciated by a person skilled in the art, the various components of the mass spectrometer system 100 can be coupled with a controller 103 and one or more power supplies 105 to receive AC, RF, and/or DC voltages selected to configure the components of system 100 for various modes of operation depending on the particular MS application. As discussed in detail below, for example, the power supply 105 can be configured to apply electrical signals to the ion guide 120 to generate an electric field therein that provides an average radial force on the ions away from the central longitudinal axis (A) and toward the axis of the offset exit aperture 112*b* (e.g., along axis (B)).

In this manner, ions transmitted by the multipole ion guide 120 through the exit aperture 112*b* can be transported through one or more additional differentially pumped vacuum stages containing the mass analyzer elements for further processing. As will be appreciated by a person skilled in the art, the vacuum stages can be maintained at sub-atmospheric pressures as is known in the art, for example, through the use of mechanical pumps (e.g., turbo-molecular pumps, rotary pumps) to evacuate the vacuum chambers to appropriate pressures. By way of non-limiting example, the vacuum chamber 112 containing the ion guide 120 can be evacuated to a pressure approximately in the range of about $1\times10^{-3}$ Torr to about 1 Torr, though other pressures can be used for this or for other purposes, for example, as noted above. Similarly, Q1 can be situated in a vacuum chamber that can be evacuated to a pressure approximately in the range of about $0.2\times10^{-5}$ Torr to about $1\times10^{-4}$ Torr, Q2 can be configured to operate as a collision cell at a pressure approximately in the range of from about 1 mTorr to about 20 mTorr, and Q3 can be operated in a variety of manners (e.g., as a scanning RF/DC quadrupole, as a quadrupole ion trap, as a linear ion trap) at a decreased operating pressure relative to that of Q2 (e.g., less than about $1\times10^{-4}$ Torr), all by way of non-limiting example.

Any number of additional ion optical elements can be included in systems in accordance with the present teachings. By way of example, the exemplary system 100 additionally includes orifice plates IQ2 disposed between Q1 and Q2, and IQ3 between Q2 and Q3 such that Q1, Q2, and Q3 can be housed in adjacent chambers separated by aperture lenses IQ2, and IQ3. In some embodiments, a set of RF-only stubby rods can be provided between neighboring pairs of rod sets to facilitate the transfer of ions therebetween. By way of non-limiting example, FIG. 1 depicts stubby rods Q1A between IQ1 and the rod set Q1 to focus the flow of ions received from the ion guide 120 into Q1. Stubby rods can also be included upstream and downstream of the elongated rod set Q2, for example.

The ion source 102 can be any known or hereafter developed ion sources and modified in accordance with the present teachings. Non-limiting examples of ion sources suitable for use with the present teachings include an atmospheric pressure chemical ionization (APCI) source, an electrospray ionization (ESI) source, a continuous ion source, a pulsed ion source, an inductively coupled plasma (ICP) ion source, a matrix-assisted laser desorption/ionization (MALDI) ion source, a glow discharge ion source, an electron impact ion source, a chemical ionization source, or a photo-ionization ion source, among others.

Figure 2:
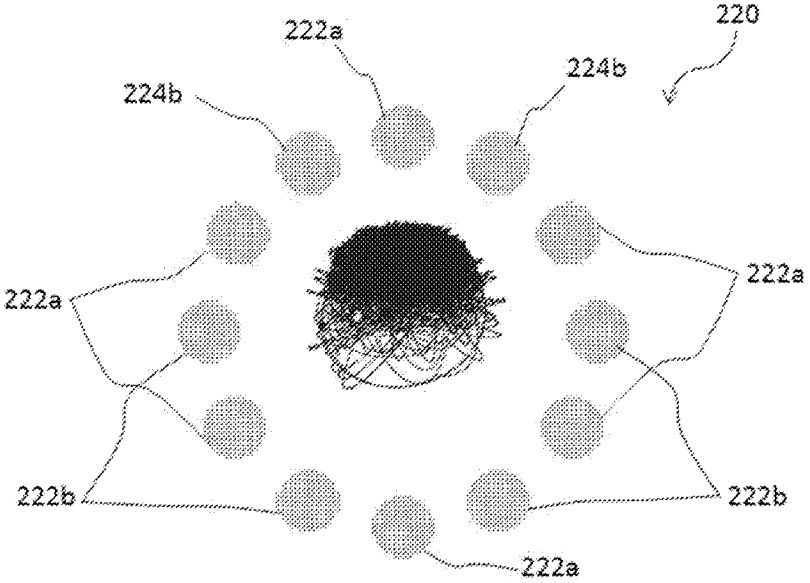
FIG. 2, in schematic diagram, illustrates a cross-sectional view of an exemplary ion guide in accordance with aspects of various embodiments of the applicant's teachings for use in the mass spectrometer system of FIG. 1.
Figure 3:
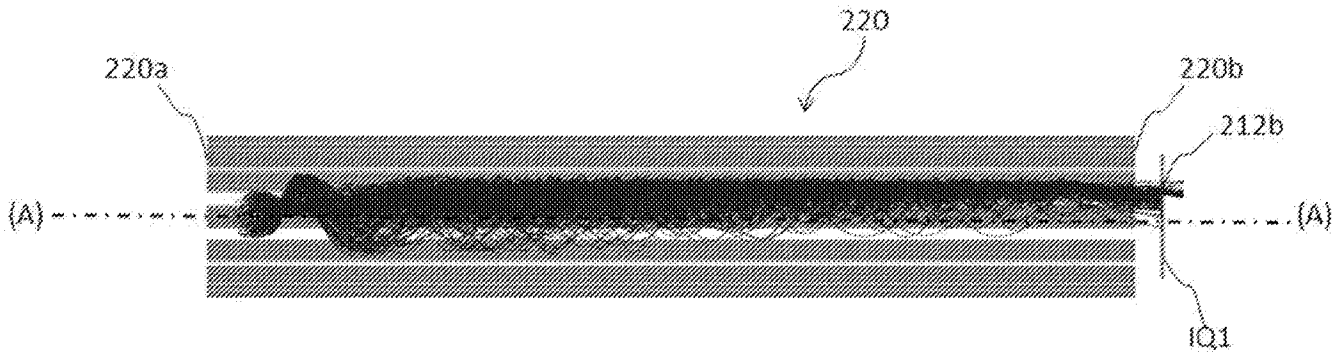
FIG. 3, in schematic diagram, illustrates a side view of the ion guide of FIG. 2.

With reference now to FIGS. 2 and 3, an exemplary ion guide 220 suitable for use as the ion guide 120 of mass spectrometer system 100 is schematically depicted. As best shown in the end view of the ion guide 220 depicted in FIG. 2, the ion guide 220 comprises twelve solid electrodes (e.g., rods having a constant cross-sectional shape and area) symmetrically disposed about a central longitudinal axis (A) of the ion guide (e.g., the geometric center of the ion guide 220). It will be appreciated that in various aspects, the electrodes extend alongside the central longitudinal axis (A) from a proximal, inlet end 220*a* disposed adjacent the inlet orifice plate (e.g., skimming plate 108 of FIG. 1) to a distal, outlet end 220*b* adjacent the orifice plate IQ1. As noted above, the inlet orifice plate includes an inlet orifice (e.g., element 112*b* of FIG. 1) disposed on the central axis (A) and through which ions are transmitted into the space between the elongate electrodes. By this arrangement of electrodes, it will be appreciated by a person skilled in the art that a balanced RF signal applied to the electrodes would be effective to generate a symmetric dodecapole electric field such that the ions accumulate (e.g., are focused) into the central area about the central longitudinal axis (A) as the kinetic energy of the ions is reduced through collisions of the ions with ambient gas molecules. For example, in exemplary conventional systems, the electrical signal applied to the twelve elongate electrodes would comprise identical RF voltages (e.g., $V_{p\text{-}p}$) and frequencies, with the signal applied to each electrode being out of phase by 180° relative to the signal applied to adjacent rods.

In accordance with various aspects of the present teachings, the electrical signal applied to the ion guide 220 of FIG. 2 (e.g., via a power supply such as power supply 105 under control of a controller 103 as discussed above with reference to FIG. 1) includes a balanced RF signal as described above as well as an additional DC signal that generates an electric field within the ion guide 220 to deflect ions (and particularly the ions of interest) away from the central longitudinal axis (A). For example, with specific reference now to FIG. 2, a first set of the electrodes (i.e., six electrodes 222*a*) have an RF signal of the same frequency, amplitude, and phase applied thereto, while the second set of six electrodes (the four electrodes 222*b*, and the two electrodes 224*b*) have an RF signal applied thereto of the same frequency and amplitude as the first set but out of phase by 180°. In addition, in accordance with various aspects of the present teachings, the two electrodes 224*b* have a DC signal applied thereto such that these two electrodes 224*b* are maintained at an attractive potential to the ions of interest relative to the remainder of the electrodes (i.e., relative to electrodes 222*a* and 222*b*). It will be appreciated that this attractive potential is not absolute (e.g., the DC signal need not be of the opposite polarity to the ions of interest), but rather that relative to the other rods in the ion guide, the DC signal applied to the non-adjacent rods 224*b* of the same RF-phase, can be less repulsive. By way of non-limiting example, if the ion source 102 were a negative ion source and all of the electrodes of the ion guide were maintained at a DC potential of −10V, a DC voltage of −7V applied to electrodes 224*b* could be attractive to the ions.

As demonstrated in the overlaid SIMION ion motion simulation of FIG. 2 (cross-sectional view) and FIG. 3 (side view), exemplary ions having an m/z of 500 Da that are received along the central longitudinal axis (A) at the inlet end 220*a* of the ion guide 220 exhibit a net radial motion toward the rods 224*b* (and away from the central longitudinal axis (A) as a result of this asymmetric field such that some of the ions are transmitted through the offset exit aperture 212*b*, while others collide with IQ1. For purposes of this simulation, the RF signal applied to each of the electrodes was $300V_{p-p}$, with the electrodes 224*b* being maintained at a 3V attractive potential relative to the remainder of the electrodes. In some aspects, the configuration of the ion guide depicted in FIGS. 2 and 3 having the exemplary RF and DC signals applied thereto can be thought of as generating an equipotential well offset from the central longitudinal axis (A) caused by the attractive DC field. As will be appreciated by a person skilled in the art in light of the present teachings, because the asymmetric electric field would have less of an effect on neutral molecules and heavy, charged clusters (e.g., having a m/z greater than 500 Da), these molecules would exhibit relatively less radial excursion from the central longitudinal axis (A) relative to the simulated ions such that they would collide with IQ1, thereby preventing their transmission into the downstream mass analyzer(s) of FIG. 1. It will also be appreciated by a person skilled in the art that the RF and DC signals applied to the exemplary electrodes of the ion guide 220, as well as the location and size of the outlet aperture 212*b*, can be optimized to maximize transmission of ions, while limiting contaminants from entering the downstream mass analyzer(s).

Figure 4A:
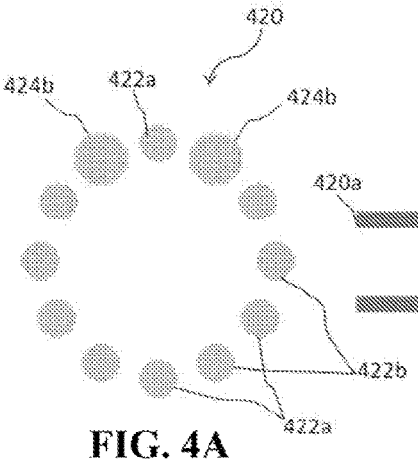
FIG. 4A, in schematic diagram, illustrates a cross-sectional view of an exemplary ion guide in accordance with aspects of various embodiments of the applicant's teachings for use in the mass spectrometer system of FIG. 1.
Figure 4B:
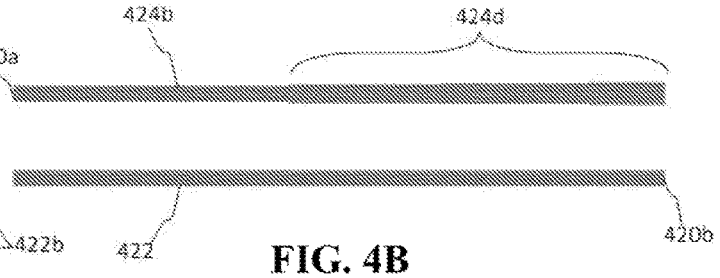
FIG. 4B, in schematic diagram, illustrates a side view of the ion guide of FIG. 4A.
Figure 4C:
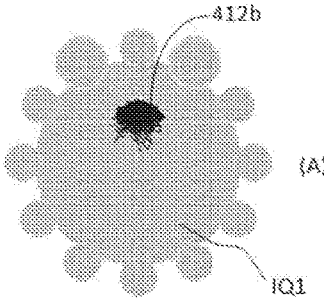
FIG. 4C, in schematic diagram, illustrates a cross-sectional view of the ion guide of FIG. 4A with an overlaid ion motion simulation.
Figure 4D:
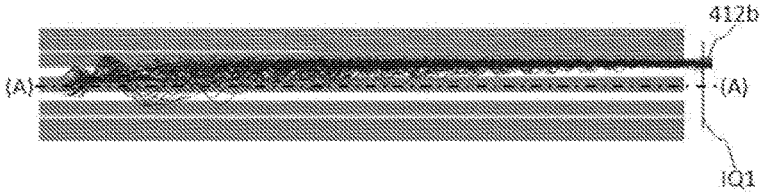
FIG. 4D, in schematic diagram, illustrates a side view of the ion guide of FIG. 4A with an overlaid ion motion simulation.

With reference now to FIGS. 4A-F, another exemplary ion guide 420 suitable for use as the ion guide 120 of mass spectrometer system 100 is schematically depicted. Ion guide 420 is substantially similar to ion guide 220, but differs in that the electrodes 424*b* to which the attractive DC potential is applied have a non-uniform cross-section. By way of example, the electrodes 424*b* can have a cross-sectional area that increases along their distal portions 424*d*, as best shown in FIGS. 4A-B. By way of non-limiting example, the distal portion 424*d* of the elongate electrodes can exhibit a substantially conical shape, while the remainder of the electrodes 422*a*, 422*b* exhibit a substantially constant cross-sectional diameter from their proximal end 420*a* to their distal end 420*b* (e.g., the electrodes are substantially cylindrical along their entire length). Though the central axis of each of the twelve electrodes (e.g., the center of mass of each rod's cross-sectional area at each point along its length) can be substantially parallel to the central longitudinal axis, the conical distal portion 424*d* of the electrodes 424*b* extend further toward the central longitudinal axis (A), which can be effective to strengthen the electric field and/or better focus the ions at the distal end 420*b* of the ion guide 420. Such an effect is demonstrated in the overlaid SIMION ion motion simulation of FIG. 4C (cross-sectional view) and FIG. 4D (side view) in which under the same simulation conditions, the ions having a m/z 500 Da exhibit tighter motion about an axis offset from the central longitudinal axis (A) (e.g., a smaller radial excursion about axis (B) of FIG. 1). For example, it will be evident to a person skilled in the art that in comparing the simulation of FIG. 3 with that of FIGS. 4C-D, the tighter focus at the distal end 420*b* can lead to more ions of interest being transmitted through an outlet aperture 412*b* of the same size as outlet aperture 212*b* and/or that it could be possible to utilize a smaller outlet aperture, thereby decreasing both the amount of contaminants and gas flowing into the downstream vacuum chamber(s).

Figure 4E:
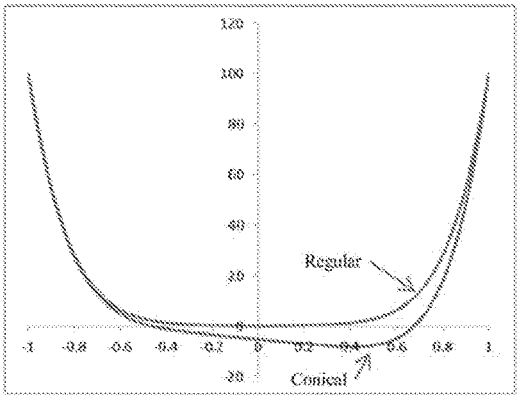
FIG. 4E depicts exemplary calculated instantaneous RF potentials generated in ion guide of FIG. 4A in accordance with various aspects of the present teachings.
Figure 4F:
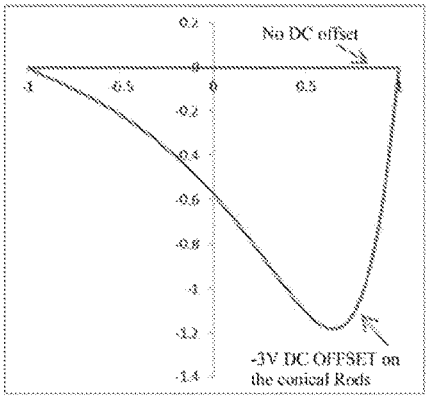
FIG. 4F depicts other exemplary calculated instantaneous RF potentials generated in ion guide of FIG. 4A in accordance with various aspects of the present teachings.

With reference now to FIGS. 4E and 4F, this can be further demonstrated through the depiction of the equipotential field strength of the RF potential across the cross-section of the ion guide 220 and 420. FIG. 4E demonstrates that for the cylindrical electrodes of FIG. 2, the instantaneous RF potential is symmetrical about the central longitudinal axis (A) in the plane transverse to the central longitudinal axis (A). However, with the conical electrodes 424*b* of FIG. 4A, the instantaneous RF potential is asymmetric and exhibits a minimum closer to the conical electrodes 424*b*. When combined with a DC attractive potential applied to electrodes 424*b*, the equipotential well becomes deeper toward the end of the ion guide 420, forcing the ions to move toward the bottom of the well when their mean radial excursions are cooled through collisions with the gas molecules.

Figure 5A:
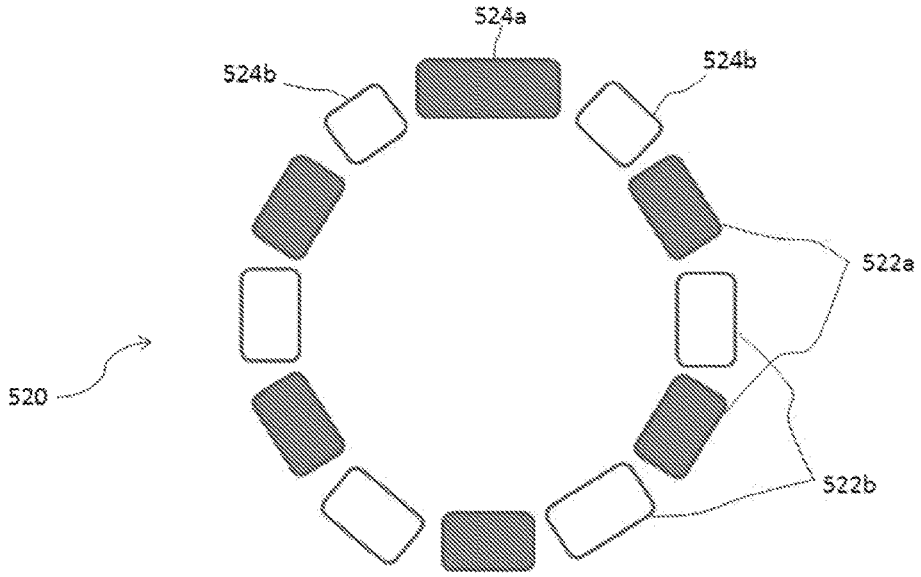
FIG. 5A, in schematic diagram, illustrates a cross-sectional view of another exemplary ion guide in accordance with aspects of various embodiments of the applicant's teachings for use in the mass spectrometer system of FIG. 1.
Figure 5B:
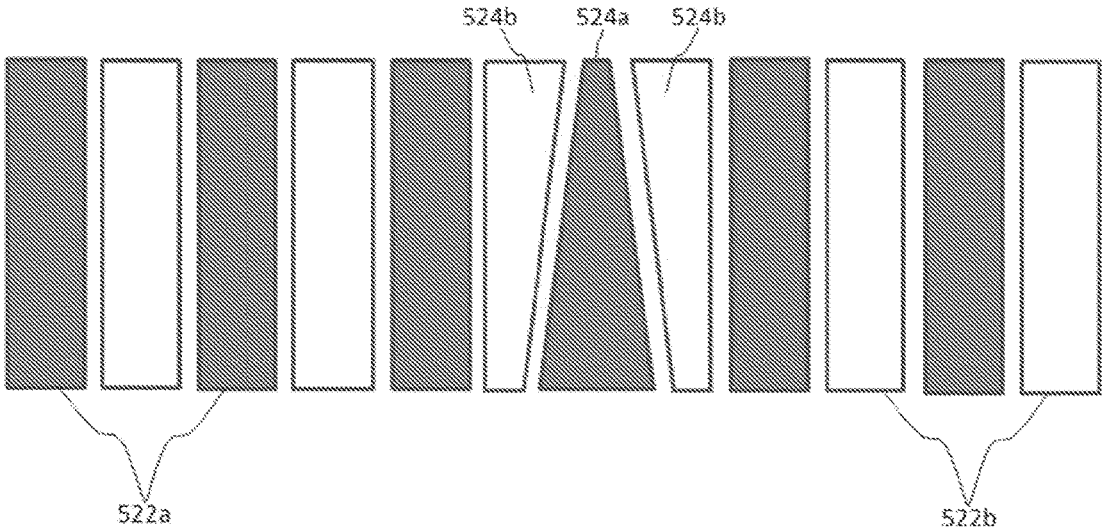
FIG. 5B, in schematic diagram, illustrates an exploded view of the ion guide of FIG. 5A.

Though the elongate electrodes of the ion guides 220 and 420 are depicted as rods having a circular cross-sectional area, elongate electrodes suitable for use in accordance with the present teachings are not so limited and can exhibit a variety of configurations. By way of example, with reference now to FIGS. 5A and 5B, another exemplary ion guide 520 suitable for use as the ion guide 120 of FIG. 1 is schematically depicted. Ion guide 520 is substantially similar to that depicted in FIGS. 4A-D but differs in that the elongate solid electrodes have a substantially rectangular cross-sectional shape (as shown in FIG. 5A). Further, though the ion guide 520 can provide increased focusing at its distal end (i.e., adjacent the outlet aperture) as demonstrated with the ion guide 420, the ion guide 520 differs in that the innermost surface of each of the electrodes of the ion guide 520 remains a constant distance from the central longitudinal axis (A) of the ion guide along its entire length (also as best shown in FIG. 5A).

As with ion guide 420 discussed above, an RF signal of the same amplitude and frequency and of opposite phases is applied to alternating electrodes (i.e., a first phase to electrodes 522*a* and a second phase to electrodes 522*b*). However, rather than having conical surfaces that extend radially inward, the flat electrodes 524*b* to which the DC attractive potential is applied are configured to provide increased focusing at the distal end by their increasing width along the length of the ion guide 520. That is, because the electrodes 524*b* to which the DC attractive potential is applied comprises a larger circumferential portion of the ion guide 520 as their width increases (while the width of the intervening electrode 524*a* correspondingly decreases), the attractive field strength becomes stronger (and the well deeper) such that the ions exhibit a net radial motion toward the rods 524*b* as the ions cool through collisions with the gas molecules.

Figure 6:
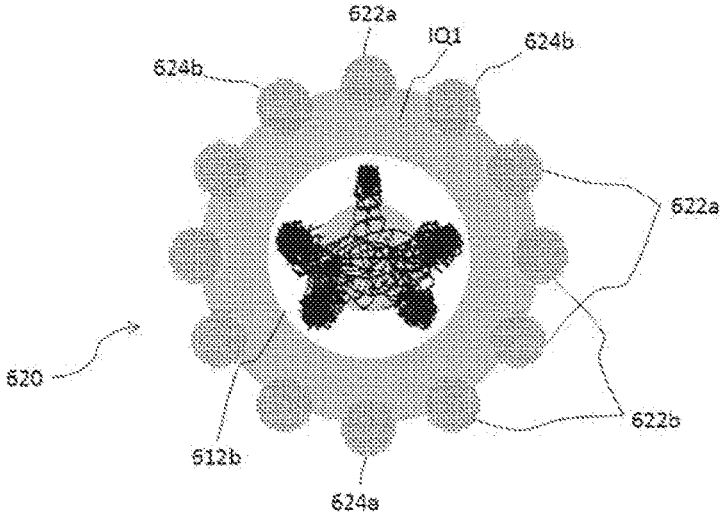
FIG. 6, in schematic diagram, illustrates a cross-sectional view of another exemplary ion guide in accordance with aspects of various embodiments of the applicant's teachings for use in the mass spectrometer system of FIG. 1.

With reference now to FIG. 6, another exemplary ion guide 620 suitable for use as the ion guide 120 of FIG. 1 is depicted. Like the ion guide 220 of FIG. 2, the ion guide 620 comprises 12 cylindrical rods disposed about the central longitudinal axis (A) of the ion guide. The ion guide 620 differs from that of FIG. 2, however, in that an attractive DC potential is not applied to the electrodes 624*b*. Rather, in the exemplary embodiment depicted in FIG. 6, each of the elongate electrodes is maintained at the same DC potential and the asymmetric field for producing an average radial force on the ions away from the central longitudinal axis (A) is instead generated through the application of an unbalanced RF field. As above, the power supply (under the control of a controller) provides an RF signal of the same frequency and of opposite phases to alternating electrodes of the ion guide 620 (i.e., an RF signal of a first phase to the five electrodes 622*a* and the electrode 624*a* and an RF signal of a second phase to the four electrodes 622*b* and the two electrodes 624*b*). However, the amplitude of the RF signal can be varied among the electrodes to generate an asymmetric electric field. By way of example, the amplitude of the RF signal to several of the electrodes can be greater than the amplitude of the RF signal applied to the remainder of the electrodes. As depicted in the SIMION simulation of ions having an m/z of 500 Da, when the amplitude of the RF signal applied to two non-adjacent electrodes 624*b* (of the same phase) and to non-adjacent electrode 624*a* (of the opposite phase) is doubled, by way of non-limiting example, the electrical field is effective to force the ions away from the central longitudinal axis (A).

Because the exemplary simulated ions having an m/z of 500 Da are substantially focused along five equipotential wells disposed about the central longitudinal axis (while the neutrals and heavy, charged molecules remain substantially along the axis), the lens IQ1 can comprise an annular outlet aperture 612*b*, as shown in FIG. 6. In such a manner, the unwanted debris could collide with the inner circle of the annular aperture 612*b* disposed on the central longitudinal axis (A), while the ions of interest are deflected from the longitudinal axis of the ion guide 620 for transmission through the annulus.

Figure 7:
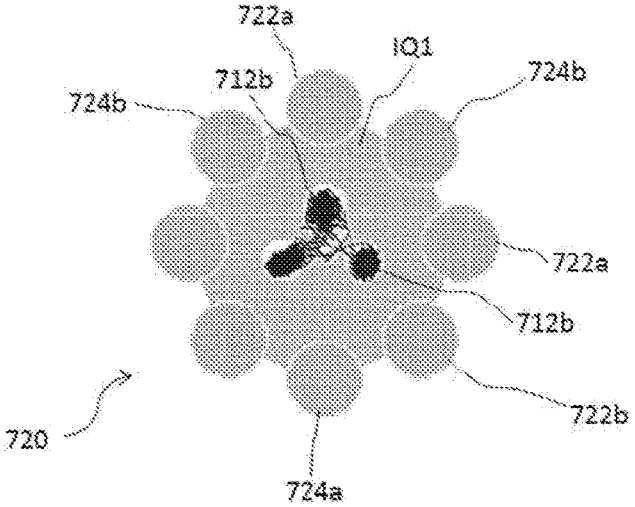
FIG. 7, in schematic diagram, illustrates a cross-sectional view of another exemplary ion guide in accordance with aspects of various embodiments of the applicant's teachings for use in the mass spectrometer system of FIG. 1.

It will be appreciated that though the above exemplary embodiments depict ion guides comprising twelve elongate electrodes, any number of electrodes can be used in methods and systems in accordance with the present teachings. For example, with reference now to FIG. 7, another exemplary ion guide 720 having eight electrodes suitable for use as the ion guide 120 of FIG. 1 is depicted. Like the ion guide 620 of FIG. 2, the ion guide 720 comprises a plurality of cylindrical rods disposed about a central longitudinal axis (A). Similarly, each of the elongate electrodes is maintained at the same DC potential. In the exemplary ion guide 720, the asymmetric field for producing an average radial force on the ions away from the central longitudinal axis (A) is instead generated through the generation of an unbalanced RF field by applying an RF signal of the same frequency and of opposite phases to alternating electrodes of the ion guide 720 (i.e., an RF signal of a first phase to the three electrodes 722*a* and the electrode 724*a* and an RF signal of a second phase to the two electrodes 722*b* and the two electrodes 724*b*). As above, the amplitude of the RF signal to the electrodes 724*a* and 724*b* is selected such that the electrical field is effective to force the ions away from the central longitudinal axis (A), focusing the ions of interest instead along three equipotential wells disposed about the central longitudinal axis (the neutrals and heavy, charged molecules again remain substantially along the axis). Moreover, the lens IQ1 can also comprise multiple outlet apertures 712*b*, as shown in FIG. 7, such that the unwanted debris could collide with IQ1 at or near the central longitudinal axis (A), while the ions of interest are deflected from the longitudinal axis of the ion guide 620 for transmission through the three outlet apertures 712*b* in IQ1.

Figure 8:
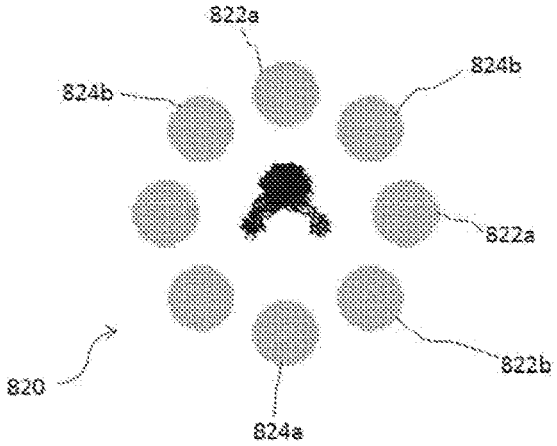
FIG. 8, in schematic diagram, illustrates a cross-sectional view of another exemplary ion guide in accordance with aspects of various embodiments of the applicant's teachings for use in the mass spectrometer system of FIG. 1.

With reference now to FIG. 8, another exemplary ion guide 820 suitable for use as the ion guide 120 of mass spectrometer system 100 is schematically depicted. Ion guide 820 is substantially similar to ion guide 720, but differs in that the two electrodes 824*b* to which the increased amplitude (and same phase) RF signal is applied also has applied thereto an attractive DC potential. The electrodes 822*a*, 824*a* and 822*b* are similar to their corresponding electrodes found in FIG. 7. As observed in comparing the simulated ion motion of FIG. 8 to that of FIG. 7, this attractive potential applied to electrodes 824*b* can be effective to focus the ions in the equipotential well closest to these electrodes. As such, it will be evident to a person skilled in the art that in comparing the simulation of FIG. 8 with that of FIG. 7, the increased concentration of ions of interest in the "upper" well can allow for a single outlet aperture to be formed in IQ1 such that the gas flowing into the downstream vacuum chamber(s) might be reduced relative to FIG. 7.

Figure 9A:
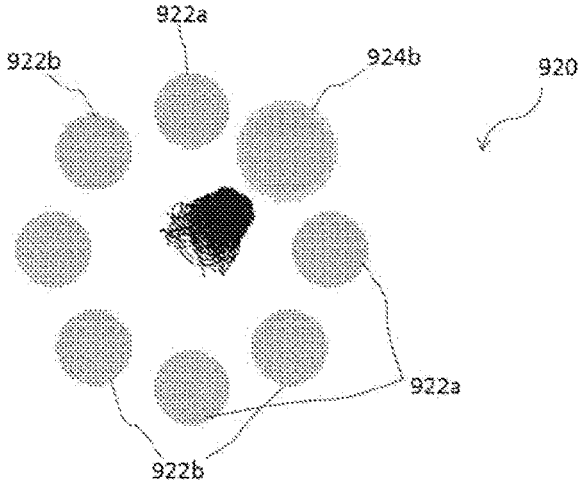
FIG. 9A, in schematic diagram, illustrates a cross-sectional view of another exemplary ion guide in accordance with aspects of various embodiments of the applicant's teachings for use in the mass spectrometer system of FIG. 1.
Figure 9B:
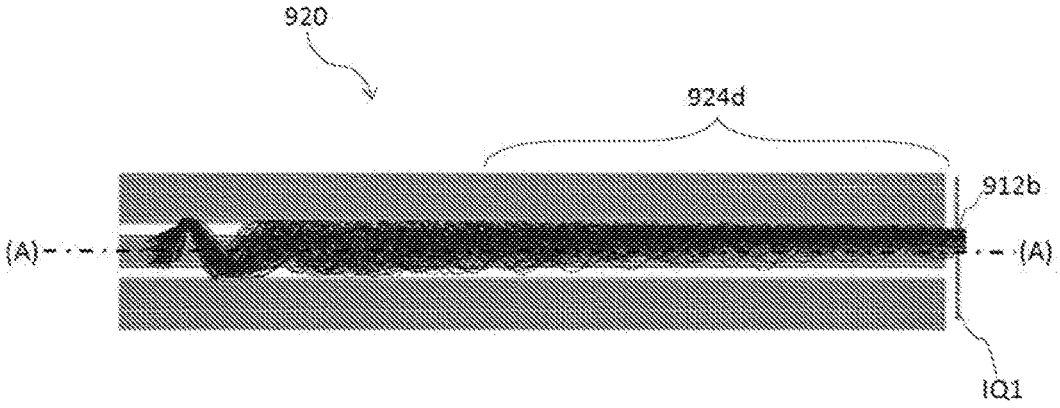
FIG. 9B, in schematic diagram, illustrates a side view of the ion guide of FIG. 9A.

With reference now to FIGS. 9A-B, another exemplary ion guide 920 suitable for use as the ion guide 120 of mass spectrometer system 100 is schematically depicted. Ion guide 920 is similar to the eight-electrode ion guides 720 and 820 of FIGS. 7 and 8 in that an unbalanced RF signal is applied to the electrodes, but differs in that the amplitude of the RF signal applied to electrode 924*b* is instead reduced relative to the remainder of the electrodes. That is, an RF signal of the same frequency and of opposite phases is applied to alternating electrodes of the ion guide 920 (i.e., an RF signal of a first phase to the four electrodes 922*a* and an RF signal of a second phase to the three electrodes 922*b* and the electrodes 924*b*). However, the amplitude of the RF signal to the electrode 924*b* is reduced such that the electrical field is less effective to restore motion of the ions toward from the central longitudinal axis (A). Moreover, by applying an attractive DC voltage on electrode 924 (which can be conical at a distal portion 924*d*), an equipotential well offset from the central longitudinal axis (A) can accumulate the ions of interest for transmission through the exit aperture 912*b*.

Those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A mass spectrometer system, comprising:

an ion source for generating ions;

an ion guide chamber, the ion guide chamber comprising an inlet orifice for receiving the ions generated by the ion source and at least one exit aperture for transmitting the ions from the ion guide chamber;

an ion guide disposed in the ion guide chamber, the ion guide comprising a plurality of elongate electrodes extending from a proximal end adjacent the inlet orifice to a distal end adjacent the exit aperture, the plurality of electrodes spaced from and extending alongside a central longitudinal axis of the ion guide so as to define an elongated space between the plurality of electrodes through which the ions are transmitted from the proximal end of the ion guide to the distal end of the ion guide, wherein the inlet orifice is disposed on the central longitudinal axis of the ion guide and the at least one exit aperture is disposed offset from the central longitudinal axis;

a power supply connected to the ion guide, wherein the power supply is configured to apply a signal to the plurality of elongate electrodes so as to generate an electric field at least at a distal portion of the ion guide that provides an average radial force on the ions away from the central longitudinal axis of the ion guide for transmission through the exit aperture;

wherein the power supply is configured to apply an RF and DC signal to each of the electrodes such that the RF signal applied to each electrode is of the same frequency and of opposite phase of the RF signal applied to adjacent electrodes; and wherein at least one electrode of said electrodes exhibits an increasing cross-sectional area along a length of said distal portion and the others of said electrodes exhibit a substantially constant cross-sectional area along said length.

2. The mass spectrometer system of claim 1, wherein the electric field exhibits a central field axis offset from the central longitudinal axis of the ion guide axis, and wherein the exit aperture is disposed on the central field axis.

3. The mass spectrometer system of claim 1, wherein the electric field at the distal portion of the ion guide exhibits a plurality of pseudopotential wells offset from the central longitudinal axis.

4. The mass spectrometer system of claim 3, wherein the at least one exit aperture comprises an annular aperture, wherein the inner circle defining the annular aperture is disposed offset from the central longitudinal axis.

5. The mass spectrometer system of claim 3, wherein the at least one exit aperture comprises a plurality of exit apertures, each of which is aligned with at least one of the plurality of pseudopotential wells.

6. The mass spectrometer system of claim 1, wherein the plurality of elongate electrodes comprises at least eight electrodes.

7. The mass spectrometer system of claim 6, wherein the power supply is configured to apply an RF signal to the electrodes such that the RF signal applied to each electrode is of the same frequency and opposite phase of the RF signal applied to adjacent electrodes, wherein three non-adjacent electrodes have an RF signal applied thereto having an amplitude greater than the RF signal applied to the remainder of the electrodes.

8. The mass spectrometer system of claim 7, wherein the power supply is further configured to apply a DC voltage to each of the electrodes such that the DC voltage applied to two of said three non-adjacent electrodes is more attractive to the ions to be transmitted from the ion guide relative to the DC voltage applied to the other of the plurality of electrodes.

9. The mass spectrometer system of claim 6:

wherein the power supply is configured to apply an RF and DC signal to each of the electrodes such that the RF signal applied to each electrode is of the same amplitude and frequency and of opposite phase of the RF signal applied to adjacent electrodes; and wherein the DC voltage applied to two non-adjacent electrodes is more attractive to the ions to be transmitted from the ion guide relative to the DC voltage applied to the other of the electrodes.

10. The mass spectrometer system of claim 9, wherein said two non-adjacent electrodes exhibit an increasing cross-sectional area along a length of said distal portion.

11. The mass spectrometer system of claim 6:

wherein the amplitude of the RF signal applied to said one electrode is less than said other electrodes; and wherein the DC voltage applied to said one electrode is more attractive to the ions to be transmitted from the ion guide relative to the DC voltage applied to the other electrodes.

12. A method of processing ions, comprising:

receiving ions generated by an ion source through an inlet orifice of an ion guide chamber;

transmitting ions through an ion guide disposed in the ion guide chamber, the ion guide comprising a plurality of elongate electrodes extending from a proximal end adjacent the inlet orifice to a distal end adjacent at least one exit aperture of the ion guide chamber, the plurality of electrodes spaced from and extending alongside a central longitudinal axis of the ion guide so as to define an elongated space between the plurality of electrodes through which the ions are transmitted from the proximal end of the ion guide to the distal end of the ion guide, wherein the inlet orifice is disposed on the central longitudinal axis of the ion guide and the at least one exit aperture is disposed offset from the central longitudinal axis;

applying an electrical signal to the plurality of elongate electrodes so as to generate an electric field at least at a distal portion of the ion guide that provides an average radial force on the ions away from the central longitudinal axis of the ion guide;

wherein applying the electrical signal to the plurality of elongate electrodes comprises applying an RF and DC signal to each of the electrodes such that the RF signal applied to each electrode is of the same frequency and of opposite phase of the RF signal applied to adjacent electrodes;

wherein at least one electrode of said electrodes exhibits an increasing cross-sectional area along a length of said distal portion and the others of said electrodes exhibit a substantially constant cross-sectional area along said length; and transmitting the ions from the ion guide through the exit aperture to one or more downstream mass analyzers.

13. The method of claim 12, wherein the electric field exhibits a central field axis offset from the central longitudinal axis of the ion guide axis, and wherein the exit aperture is disposed on the central field axis.

14. The method of claim 12, wherein the electric field at the distal portion of the ion guide exhibits a plurality of pseudopotential wells offset from the central longitudinal axis.

15. The method of claim 12, wherein the plurality of elongate electrodes comprises at least eight electrodes.

16. The method of claim 15, wherein applying the electrical signal to the plurality of elongate electrodes comprises applying an RF signal to each electrode of the same frequency and opposite phase of the signal applied to adjacent electrodes such that three non-adjacent electrodes have an RF signal applied thereto having an amplitude greater than the RF signal applied to the remainder of the electrodes.

17. The method of claim 16, wherein applying the electrical signal to the plurality of elongate electrodes further comprises applying a DC voltage to each of the electrodes such that the DC voltage applied to two of said three non-adjacent electrodes is more attractive to the ions to be transmitted from the ion guide relative to the DC voltage applied to the other of the plurality of electrodes.

18. The method of claim 15, wherein applying the electrical signal to the plurality of elongate electrodes comprises:

applying an RF signal to each of the electrodes of the same amplitude and frequency and of opposite phase of the RF signal applied to adjacent electrodes; and applying a DC voltage to two non-adjacent electrodes that is more attractive to the ions to be transmitted from the ion guide relative to the DC voltage applied to the other of the electrodes.

19. The method of claim 15, wherein the amplitude of the RF signal applied to said one electrode is less than said other electrodes; and wherein the DC voltage applied to said one electrode is more attractive to the ions to be transmitted from the ion guide relative to the DC voltage applied to the other electrodes.

* * * * *